US005129834A

United States Patent [19]

Cranford

[11] Patent Number: 5,129,834

[45] Date of Patent: Jul. 14, 1992

[54] MULTIPLE FUNCTION ELECTRICAL CONNECTOR FOR CONNECTING TO A FUEL-RAIL-MOUNTED FUEL INJECTOR

[75] Inventor: Stephen C. Cranford, Newport News, Va.

[73] Assignee: Siemens Automotive L.P., Auburn Hills, Mich.

[21] Appl. No.: 664,253

[22] Filed: Mar. 4, 1991

[51] Int. Cl.[5] ..... F02M 39/00; H01R 13/627

[52] U.S. Cl. ..... 439/130; 123/456; 123/470

[58] Field of Search ..... 123/456, 468, 469, 470; 439/34, 130

[56] References Cited

U.S. PATENT DOCUMENTS

| | | | |
|---|---|---|---|
| 4,570,601 | 2/1986 | Ito et al. | 123/468 |
| 4,681,691 | 7/1987 | Schriver, Jr. | 439/130 |
| 4,844,036 | 7/1989 | Bassler | 123/470 |
| 4,950,171 | 8/1990 | Myzslay | 123/470 |
| 5,016,594 | 5/1991 | Hafner et al. | 123/456 |
| 5,030,116 | 7/1991 | Sakai et al. | 123/470 |

*Primary Examiner*—Gary F. Paumen

*Attorney, Agent, or Firm*—George L. Boller; Russel C. Wells

[57] ABSTRACT

An electrical connector for connecting electric wiring to a mating connector of a fuel-rail-mounted electric-operated fuel injector. The connector and the fuel rail have integral formations that serve to assure circumferential orientation of the injector in a socket of the fuel rail and to axially capture the injector in the socket. A snap-catch mechanism releasably locks the connector to the injector and is provided by further integral formations on the wiring connector and the injector connector. In this way, extra attaching parts are not required. The fuel rail assembly has a lower profile which is advantageous from the standpoint of engine compartment packaging in an automotive vehicle.

12 Claims, 1 Drawing Sheet

MULTIPLE FUNCTION ELECTRICAL CONNECTOR FOR CONNECTING TO A FUEL-RAIL-MOUNTED FUEL INJECTOR

FIELD OF THE INVENTION

This invention relates generally to fuel rails for fuel-injected internal combustion engines, and in particular to an electrical connector for connecting to a fuel-rail-mounted fuel injector in a novel and advantageous manner.

BACKGROUND AND SUMMARY OF THE INVENTION

In the manufacture of fuel rail assemblies, it is a customary practice for the retention of a fuel injector in a fuel rail socket, the orientation of the fuel injector in the socket, and the electrical connection to the fuel injector to be performed as independent actions. For example, a typical fuel rail assembly that has bottom-feed fuel injectors has features molded into the molded plastic fuel rail that require the fuel injector to be properly circumferentially oriented in the fuel rail socket. Such circumferential orientation is essential in the case of split-stream type fuel injectors. A fuel injector is retained in the fuel rail socket by placing a metal clip over each injector and fastening the clip to the fuel rail by means of a fastener such as a screw, or by placing a cover plate over all injectors in a rail and fastening the cover plate to the rail. Another example involves a complex and expensive molded cover that makes electric connection to the injectors, retains the injectors, and must be releasably attached to the rail. When a fuel rail is made of metal, rather than molded from plastic, the task of incorporating retention and orienting features becomes more difficult.

The present invention relates to a new and improved electrical connector for making electrical connection to a fuel-rail-mounted fuel injector in a manner that assures proper retention and circumferential orientation of a fuel injector with less complications than heretofore. Advantages of the invention include: reduced cost and the elimination of separate attaching parts. The completed fuel rail assembly can exhibit a lower profile than prior fuel rail assemblies, and this is especially advantageous from the standpoint of engine compartment packaging in an automotive vehicle.

Further features, advantages, and benefits of the invention, along with those just mentioned, will be seen in the ensuing detailed disclosure which includes a written description and drawings of a presently preferred embodiment according to the best mode contemplated at this time for carrying out the invention.

DESCRIPTION OF THE PREFERRED EMBODIMENT

Figure 1:
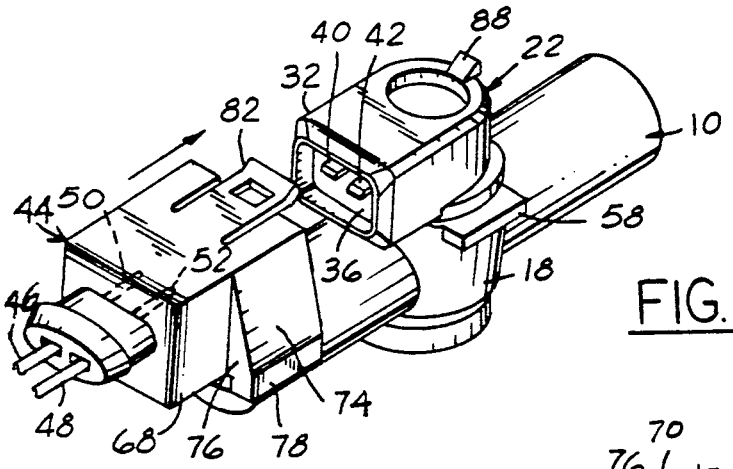
FIG. 1 is a perspective view from a particular direction of an embodiment of the invention, showing a partially assembled condition.
Figure 2:
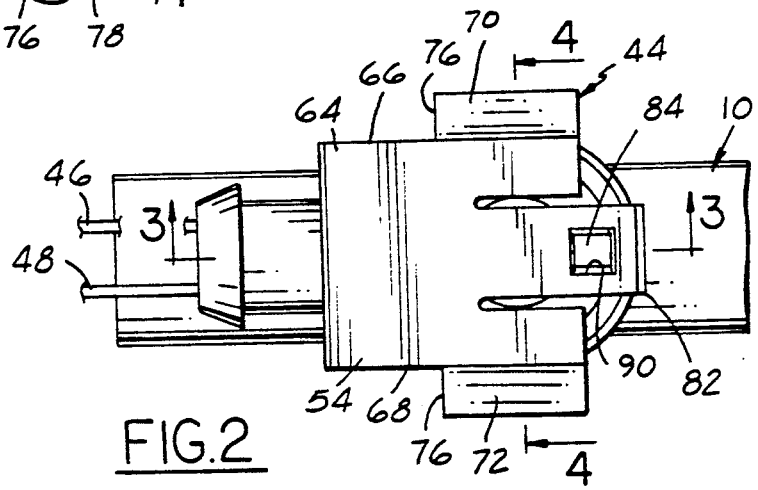
FIG. 2 is a top plan view of FIG. 1 on a larger scale.

A main fuel rail tube 10 is fabricated from suitable plastic by injection molding to comprise a cylindrical sidewall 12 that bounds a longitudinal hole 14. The longitudinal axis of tube 10 is coaxial with hole 14 and is designated by the numeral 16. Tube 10 is also formed with several walled sockets 18 at spaced apart intervals along the length of axis 16, only one such socket being shown in the Figs. for conciseness.

Socket 18 comprises a circular through-hole 20 whose axis is perpendicular to axis 16. The socket is shaped to receive an electric-operated fuel injector 22, and the Figs. show the fuel injector disposed in the socket in a sealed manner through the use of 0-ring seals 24, 26. It is to be observed in FIGS. 3 and 4 that the upper end (as viewed in those Figs.) of through-hole 20 is larger than the lower end. This allows fuel injector 22 to be disposed in socket 18 by inserting the fuel injector coaxially into the socket via the upper end of through-hole 20 and advancing the fuel injector into the socket until it is seated in the installed position depicted in the Figs. In the fuel injector's installed position, a central region of the injector which contains one or more fuel inlet holes 28 is in communication with hole 14, a nozzle 30 of the injector is at the lower end of through-hole 20, and an electrical connector 32 of the injector is exterior of socket 18 adjacent the upper end of the socket. In use, pressurized fuel, such as gasoline, in hole 14 enters the injector via holes 28.

Electrical connector 32 comprises a shell 34, preferably made of plastic, that has a generally rectangular opening 36 facing in a direction which is parallel to axis 16 and which constitutes the connector's axis 38. Extending from opening 36, shell 34 bounds the distal ends of two electrical terminals 40, 42 that are on opposite sides of, and parallel to, axis 38. These two terminals are anchored to the fuel injector internally of the fuel injector body and are joined with the terminations of a solenoid coil within the fuel injector body. In use, the application of electric energy to the solenoid coil via terminals 40, 42 energizes the solenoid to cause fuel to be injected from nozzle 30 of injector 22 for entrainment with induction air to form a combustible mixture for the engine's cylinders.

Electrical energy is delivered to the fuel injector through a complementary connector 44 that mates with connector 32. Connector 44 is part of wiring that leads from an engine management computer (not shown) to each fuel injector. Two wires 46, 48 of that wiring lead to the illustrated fuel injector via the mated connectors 32, 44. Within connector 44 respective ends of wires 46, 48 connect to respective electrical terminals 50, 52 that are anchored to a shell 54, preferably plastic, of connector 44. The distal ends of respective terminals 50, 52 establish electrically conductive contact with terminals 40 and 42 respectively when the two connectors 32, 44 are mated, as in FIGS. 3 and 4.

Shell 54 is constructed to have an opening that faces opening 36 of connector 32 and allows for shell 54 to be telescoped over the end of shell 34 to make the respective connections between the connectors' terminals. Tube 10 and connector 44 have further features that provide for the retention and orientation of the fuel injector within socket 18. These features are a pair of parallel flanges 56, 58 on opposite sides of socket 18 on the exterior of the socket adjacent the larger end of through-hole 20, and a pair of parallel flanges 60, 62 on opposite sides of shell 54. Shell 54 may be considered to have an upper wall 64 and two sidewalls 66, 68 that depend from the side edges of upper wall 64. Sidewalls 66, 68 are flat and perpendicular to upper wall 64 along a zone that is essentially coextensive with terminals 50, 52, but are shaped into alcoved bays 70, 72 from said zone to the opening of shell 54 that faces opening 36 of connector 32. Each alcoved bay 70, 72 comprises an inclined sidewall portion 74 extending from upper wall 64 and an endwall portion 76. Flanges 60, 62 are disposed at the lower edges of sidewall portions 74 and form the lower margins of the alcoved bays. Each flange 60, 62 is essentially a right angle comprising a vertical (as viewed in FIGS. 3 and 4) flange portion 78 and a horizontal flange portion 80 that extends inwardly from the lower edge of the vertical flange portion 78. Endwall portion 76 closes each bay opposite the opening of shell 54 that faces opening 36 of connector 32.

Fuel injector 22 and socket 18 can be constructed without the need to have a keyed fit of the injector to the socket for circumferentially orienting the injector to the socket. Proper circumferential orientation of the injector to the socket is assured by the coaction therewith of connector 44. Injector 22 is assembled into socket 18 and circumferentially oriented such that axis 38 is parallel with axis 16. Connector 44 is disposed coaxial with axis 38 in the manner portrayed by FIG. 1, and is then bodily advanced toward connector 32. As the advancement occurs, shell 54 telescopes over shell 34, terminals 50, 52 make with terminals 40, 42 respectively, flanges 60 and 56 mutually engage in the manner of FIG. 4, as do flanges 62 and 58, and upper wall 64 passes closely over the fuel injector. The action of horizontal flange portions 80 with flanges 56, 58 provides an interference which prevents connector 44 from being separated from tube 10 except by retracting the connector in the opposite direction from which it was advanced; in other words, the interference prevents the connector from being bodily moved transversely of tube 10 and hence the fuel injector cannot be removed from socket 18 because it is axially captured within the socket by the overlying upper wall 64 of connector 44. However, when connector 44 is disconnected from connector 32, the fuel injector can be removed from the socket. The action of vertical flange portions 78 with flanges 56, 58 assures that the circumferential orientation of the fuel injector within the socket is maintained since the action prevents rotation of connector 44 about the coaxis of the fuel injector and the socket, and the engagement of connector 44 with the injector precludes relative rotation therebetween.

Figure 3:
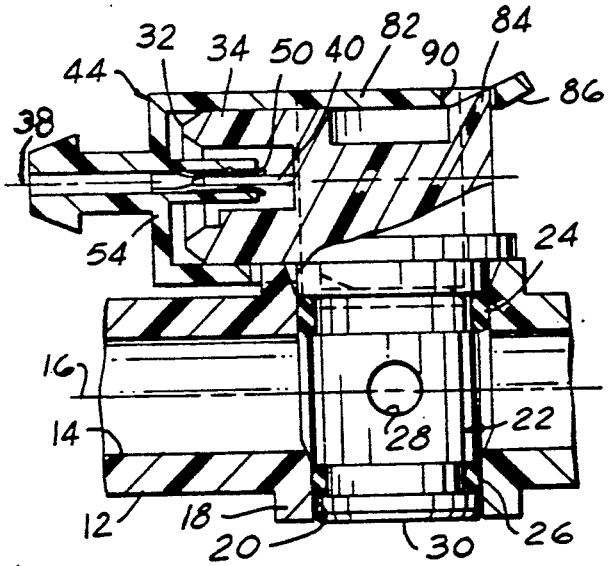
FIG. 3 is a longitudinal cross section through FIG. 2 in the direction of arrows 3—3.
Figure 4:
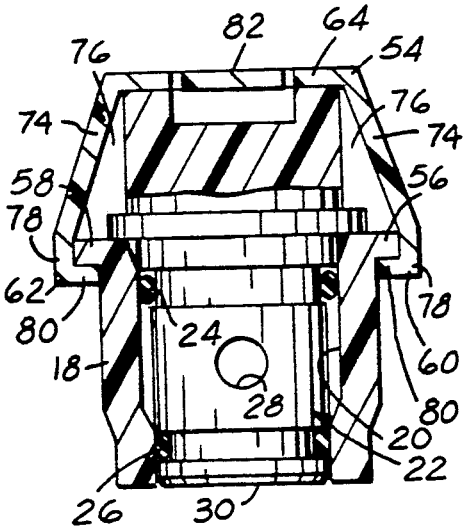
FIG. 4 is a transverse cross section through FIG. 2 in the direction of arrows 4—4.

A further desirable feature is provided by a snap-catch mechanism that serves to releasably lock connector 44 to the fuel injector when the connectors 44 and 32 are fully mated, as in FIGS. 3 and 4. This mechanism comprises a tongue 82 that is provided on upper wall 64 and a catch 84 that is provided on shell 34 of the fuel injector. The distal end of tongue 82 comprises a cammed surface 86 and the top of catch 84 comprises a camming surface 88. Toward the end of the motion that mates connector 44 with connector 32, surfaces 86 and 88 abut. As the motion continues, tongue 82 is resiliently flexed, allowing the tongue to pass over the catch until the catch registers with an aperture 90 in the tongue proximal to surface 86. Upon such registry, the tongue snaps back (i.e., relaxes), causing the catch to be disposed within the aperture. This creates an interference that prevents the two connectors from being disconnected unless the tongue is first flexed out of interference with the catch. Since such flexure is not apt to accidentially occur, it is anticipated that an intentional act will be necessary to disconnect the two connectors. Accordingly, the snap-catch mechanism greatly reduces the liklihood of accidental separation of connector 44 from the fuel rail assembly.

Thus, the invention has been shown to perform multiple functions without the use of separate parts. Flanges 56 and 58 are integral formations of tube 10. Flanges 60 and 62 are integral formations of connector 44. Tongue 82 is an integral formation of connector 44 and catch 84 is an integral formation of shell 34 of connector 32 of injector 22. Although not explicitly shown in the drawing Figs., the two connectors 32, 44 could embody a camming feature that facilitates mating in the event of small amounts of non-parallelism between connector 32 and axis 16 after injector 22 has been inserted into socket 18.

While a presently preferred embodiment of the invention has been illustrated and described, it should be appreciated that principles may be practiced in other equivalent embodiments.

What is claimed is:

1. A fuel rail assembly for an internal combustion engine, said fuel rail assembly comprising a main fuel rail tube comprising a socket into an open end of which an electric-operated fuel injector has been inserted, said main fuel rail tube serving to provide a supply of pressurized liquid fuel to said fuel injector so that said fuel injector can, when electrically energized, inject fuel into an engine for entrainment with air to form a combustible mixture that is ignited within a combustion chamber space to power such an engine, said fuel injector having an electrical connector that is disposed exterior of said socket and mated with a complementary electrical connector of electrical wiring via which electric current is conveyed to said fuel injector for electrically energizing said fuel injector, characterized in that said main fuel rail tube, said fuel injector and said complementary electrical connector comprise respective integral formations which coact to axially capture said fuel injector in said socket such that said fuel injector cannot be removed from said socket via said open end of said socket, to circumferentially orient said fuel injector in said socket such that said fuel injector is constrained against circumferential rotation within said socket, and to releasably lock said complementary electrical connector and said fuel injector together, characterized further in that said integral formations comprise flanges on said main fuel rail tube on opposite sides of the exterior of said socket and flanges on opposite sides of said complementary electrical connector that coact with said flanges on said main fuel rail tube to cause said complementary electrical connector to axially capture said fuel injector in said socket such that said fuel injector can be removed from said socket via said open end of said socket, and to cause said fuel injector to be circumferentially oriented and constrained against circumferential rotation within said socket.

2. A fuel rail assembly for an internal combustion engine, said fuel rail assembly comprising a main fuel rail tube having a longitudinal axis and comprising a transverse socket into an open end of which an electric-operated fuel injector has been inserted, said main fuel rail tube serving to provide a supply of pressurized liquid fuel to said fuel injector so that said fuel injector can, when electrically energized, inject fuel into an engine for entrainment with air to form a combustible mixture that is ignited within a combustion chamber space to power such an engine, said fuel injector having an electrical connector that is disposed exterior of said socket and mated with a complementary electrical connector of electrical wiring via which electric current is conveyed to said fuel injector for electrically energizing said fuel injector, characterized in that the axis of said electrical connector of said fuel injector and the axis of said complementary electrical connector are parallel with said longitudinal axis of said main fuel rail tube so that the act of mating said complementary electrical connector with said fuel injector's electrical connector occurs by bodily advancing said complementary electrical connector coaxially toward said fuel injector's electrical connector parallel with said longitudinal axis of said main fuel rail tube, and said main fuel rail tube and said complementary electrical connector comprise respective flange means which come into mutual engagement during the act of mating said complementary electrical connector with said fuel injector's electrical connector and which serve to cause said complementary electrical connector to axially capture said fuel injector in said socket such that said fuel injector cannot be removed from said socket via said open end of said socket and to cause said fuel injector to be circumferentially oriented and constrained against circumferential rotation within said socket.

3. A fuel rail assembly as set forth in claim 2 characterized further in that said respective flange means comprise respective integral flange formations that are integral with said main fuel rail tube and said complementary electrical connector respectively.

4. A fuel rail assembly as set forth in claim 3 characterized further in that said integral flange formation on said main fuel rail tube comprises a pair of parallel flanges on opposite sides of said socket and said integral flange formation on said complementary electrical connector comprises a pair of parallel flanges on opposite side of said complementary electrical connector.

5. A fuel rail assembly as set forth in claim 2 characterized further by the inclusion of releasable locking means for releasably locking said complementary electrical connector and said fuel injector together at completion of the act of mating said complementary electrical connector with said fuel injector's electrical connector.

6. A fuel rail assembly as set forth in claim 5 characterized further in that said releasable locking means comprises respective further integral formations on said fuel injector and said complementary electrical connector.

7. A fuel rail assembly for an internal combustion engine, said fuel rail assembly comprising a main fuel rail tube having a longitudinal axis and comprising a transverse socket into an open end of which an electric-operated fuel injector has been inserted so that the main longitudinal axis of the fuel injector is coaxial with the longitudinal axis of the socket, said main fuel rail tube serving to provide a supply of pressurized liquid fuel to said fuel injector so that said fuel injector can, when electrically energized, inject fuel into an engine for entrainment with air to form a combustible mixture that is ignited within a combustion chamber space to power such an engine, said fuel injector having an electrical connector that is disposed exterior of said socket and mated with a complementary electrical connector of electrical wiring via which electric current is conveyed to said fuel injector for electrically energizing said fuel injector, characterized in that said complementary electrical connector, said main fuel rail tube, and said fuel injector comprise means for requiring the act of mating said complementary electrical connector with said fuel injector's electrical connector to occur by bodily advancing said complementary electrical connector toward said fuel injector along a direction which is non-parallel to said main longitudinal axis of said fuel injector and means that are part of and coact between said main fuel rail tube and said complementary electrical connector during and after such bodily advancement to cause said complementary electrical connector to capture said fuel injector in said socket such that said fuel injector cannot be removed from said socket via said open end of said socket and to cause said fuel injector to be circumferentially oriented and constrained against circumferential rotation within said socket.

8. A fuel rail assembly as set forth in claim 7, characterized further in that said means that are part of and coact between said main fuel rail tube and said complementary electrical connector during and after such bodily advancement to cause said complementary electrical connector to capture said fuel injector in said socket such that said fuel injector cannot be removed from said socket via said open end of said socket an to cause said fuel injector to be circumferentially oriented and constrained against circumferential rotation within said socket comprises respective integral formations on said main fuel rail tube and said complementary electrical connector.

9. A fuel rail assembly as set forth in claim 8 characterized further in that said direction which is non-parallel to said main longitudinal axis of said fuel injector is perpendicular to said main longitudinal axis of said fuel injector.

10. A fuel rail assembly as set forth in claim 9 characterized further in that said direction which is non-parallel to said main longitudinal axis of said fuel injector is also parallel to said longitudinal axis of said main fuel rail tube.

11. A fuel rail assembly as set forth in claim 8 characterized further by the inclusion of releasable locking means for releasably locking said complementary electrical connector ahd said fuel injector together at completion of the act of mating said complementary electrical connector with said fuel injector's electrical connector.

12. A fuel rail assembly as set forth in claim 11 characterized further in that said releasable locking means comprises a snap-catch mechanism that snap-catches said complementary electrical connector and said fuel injector to releasably lock the two together, said snap-catch mechanism comprises an apertured tongue that is cantilever-mounted on said complementary electrical connector and a catch on said fuel injector that is disposed within the aperture of said tongue, and said catch has a camming surface portion and said apertured tongue comprises a cammed surface portion, and said two surface portions coact during the mating of said complementary electrical connector with said fuel injector's connector to cause said apertured tongue to be resiliently flexed by said catch until said catch is in registry with the aperture in said tongue whereupon said tongue relaxes to cause said catch to be disposed in the aperture of said tongue and thereby releasably lock said complementary electrical connector and said fuel injector together.

* * * * *